US007153057B1

(12) United States Patent
Lucas

(10) Patent No.: US 7,153,057 B1
(45) Date of Patent: Dec. 26, 2006

(54) SECURABLE TEMPORARY MANHOLE COVER

(76) Inventor: Anthony Lucas, 6 Newport Ct., Long Branch, NJ (US) 07740

( * ) Notice: Subject to any disclaimer, the term of this patent is extended or adjusted under 35 U.S.C. 154(b) by 0 days.

(21) Appl. No.: 11/347,996

(22) Filed: Feb. 6, 2006

(51) Int. Cl.
*E02D 29/14* (2006.01)

(52) U.S. Cl. ..... 404/25

(58) Field of Classification Search ..... 404/25; 52/19, 20

See application file for complete search history.

(56) References Cited

U.S. PATENT DOCUMENTS

| | | | | |
|---|---|---|---|---|
| 1,940,924 | A | 12/1933 | Taylor | |
| 3,294,000 | A | 12/1966 | Pelsue | |
| 3,946,761 | A * | 3/1976 | Thompson et al. | 138/98 |
| 4,029,425 | A * | 6/1977 | Pelsue | 404/25 |
| 4,050,839 | A * | 9/1977 | Vollmar | 404/72 |
| 4,373,381 | A * | 2/1983 | Kulp et al. | 73/40.5 R |
| 4,469,467 | A * | 9/1984 | Odill et al. | 404/25 |
| 4,614,206 | A * | 9/1986 | Mathison et al. | 138/93 |
| 4,763,511 | A * | 8/1988 | Mathison et al. | 73/49.1 |
| 5,046,886 | A * | 9/1991 | Muir et al. | 404/25 |
| 5,052,851 | A | 10/1991 | Frishauf | |
| 5,333,653 | A * | 8/1994 | Rzesutock et al. | 141/1 |
| 6,007,270 | A | 12/1999 | Bowman | |
| 6,152,455 | A | 11/2000 | Brockway et al. | |
| 6,682,257 | B1 | 1/2004 | Zappe | |
| 6,887,012 | B1 | 5/2005 | Zappe | |
| 6,953,194 | B1 | 10/2005 | Brockway | |

FOREIGN PATENT DOCUMENTS

| | | |
|---|---|---|
| EP | 1.329.558 | 7/2003 |
| GB | 1.032.839 | 6/1966 |
| GB | 2.285.473 | 7/1995 |
| JP | 2000055289 | 2/2000 |

* cited by examiner

*Primary Examiner*—Gary S. Hartmann
(74) *Attorney, Agent, or Firm*—Michael I. Kroll

(57) ABSTRACT

An improved temporary manhole insert for securing a manhole passageway having a generally cylindrical structure with an inflatable, ring like tube encompassing the outer rim of the rigid portion of the insert. The insert with the inflatable ring is placed within the manhole aperture and then inflated to expand until the insert is secured in position. The manhole insert of the present invention prevents debris such as rocks, dust, asphalt and other debris from falling into the manhole during adjustments to the casting and also prevents debris from going into the sewer system such as pipes and pumps.

9 Claims, 9 Drawing Sheets

SECURABLE TEMPORARY MANHOLE COVER

BACKGROUND OF THE INVENTION

1. Field of the Invention

The present invention relates generally to man hole covers and, more specifically, to an improved temporary manhole insert for securing a manhole passageway having a generally cylindrical structure with an inflatable, ring like structure encompassing the outer rim of the removable plate portion of the insert.

The insert with the inflatable rim is placed within the manhole aperture and then inflated to expand until the insert is secured in position. Once positioned therein, passage is provided through the removal of a pliable center plate. The manhole insert of the present invention prevents debris such as rocks, dust, asphalt and other debris from falling into the manhole during adjustments to the casting for asphalt overlay.

2. Description of the Prior Art

There are other cover devices designed for manholes. Typical of these is U.S. Pat. No. 1,940,924 issued to Taylor on Dec. 26, 1933.

Another patent was issued to Pelsue on Dec. 27, 1966 as U.S. Pat. No. 3,294,000. Yet another U.S. Pat. No. 5,052,851 was issued to Frishauf on Oct. 1, 1991 and still yet another was issued on Dec. 28, 1999 to Bowman as U.S. Pat. No. 6,007,270.

Another patent was issued to Brockway, et al. on Nov. 28, 2000 as U.S. Pat. No. 6,152,455. Yet another U.S. Pat. No. 6,682,257 was issued to Zappe on Jan. 27, 2004. Another was issued to Zappe on May 3, 2005 as U.S. Pat. No. 6,887,012 and still yet another was issued on Oct. 11, 2005 to Brockway as U.S. Pat. No. 6,953,194.

Another patent was issued to Pelsue on Jun. 15, 1966 as U.K. Patent No. GB1032839. Yet another U.K. Patent No. GB2285473 was issued to Mitchell, et al. on Jul. 12, 1995. Another was issued to Tamio on Feb. 22, 2000 as Japanese Patent No. Feb. 22, 2000 and still yet another was issued on Jul. 23, 2003 to Gudrun, et al. as European Patent Application EP1329558.

U.S. Pat. No. 1,940,924

Inventor: Ivy F. Taylor

Issued: Dec. 26, 1933

A seat facing joint or cushion for street manhole covers, comprising a plurality of strand of long fibered material arranged parallel to each other and side by side, and an adhesive slow flowing material impregnating said strands.

U.S. Pat. No. 3,294,000

Inventor: Thurman A. Pelsue

Issued: Dec. 27, 1966

An above-ground detachable extension for manholeholes and the like of a type bordered by a ring having an annular lid-supporting shoulder recessed into the top thereof which comprises: an upstanding tubular member sized to define a continuation of the manhole bordering ring, means carried by the tubular element located adjacent to both ends thereof to produce a continuous annular channel sized for insertion into the recess formed above the lid-supporting shoulder of the manhole ring, said channel-producing means cooperating with that portion of the manhole ring lying above the lid-supporting shoulder to define a substantially enclosed continuous annular gasket cavity, the channel producing means includes a pair of radial spaced apart flanges located at each end of said tubular element, cylindrical wall sections bridging the spaces between each pair of flanges in integral relation, the cylindrical wall section of the first pair of flanges comprises a portion of the tubular element with one of said flanges bordering the edge of the tubular U.S. Pat. No. 5,052,851

Inventor: Stephen H. Frishauf

Issued: Oct. 1, 1991

To provide a temporary cover for a maintenance hole (1, 31), over an edge (5) of which cables, hoses or other conduits (3, 83) extend, an inflatable balloon (10, 40, 50, 60, 70, 80) has hollow circumferential portions (41, 51, 61, 71, 81), for example generally in the shape of a tire or hollow disk, connected by a web (12), the balloon having a plan view configuration and dimension to fit into and, upon inflation, over the edge of the maintenance hole, and resiliently engaging around the edge of the maintenance hole, thereby preventing ingress of water, contaminants, animals and the like, without damage to the cables, hoses or conduits. Preferably, the balloon is a unitary structure made of distendable material such as rubber, plastic or the like, which may be fiber or textile reinforced.

U.S. Pat. No. 6,007,270

Inventor: Harold M. Bowman

Issued: Dec. 28, 1999

A manhole frame assembly for supporting a member that can obstruct an access opening when the level of a construction material around the opening is raised, includes an outer frame member having a support surface and a side wall extending from the support surface. The side wall is constructed and arranged with an upper surface that is substantially flush with an original level of the construction material. An inner frame member can be received on the support surface and includes a surface for supporting a member for obstructing the access opening. The side wall includes an abutment device for preventing upward movement of the inner frame member when the original level of construction material around the outer frame member is raised. A portion of the inner frame member is movable in a direction transverse to a direction of a length of the access opening. Other features of the invention are directed to a method of fastening the inner frame to the outer frame and an apparatus for fastening the obstructing member to a manhole frame structure.

U.S. Pat. No. 6,152,455

Inventor: Robert D. Brockway

Issued: Nov. 28, 2000

The expandable band is used to secure a sealing element within a generally cylindrical structure, such as a pipe or manhole, or other round hole. The expandable band includes a band body having a first band end portion and a second band end portion. A plurality of slots are disposed in the first band end portion, and a locking member extends from the second band end portion. The locking member includes a tab for extending through the second band end portion and into one of the plurality of slots to lock the expandable band at the desired diameter. An end section of the second band end portion extends beyond the tab of the locking member to ease the transition between the overlapping first and second band end portions. When the band is expanded, the tab is disengaged from the slots and slides over the slots, allowing the first and second band end portions to move relative to one another. At the desired diameter, the tab engages one of the slots to lock the band at the desired diameter. The locking member is disposed on the outside region of the band with the tab extending inward such that the sealing member provides a resilient backing against the locking member.

U.S. Pat. No. 6,682,257

Inventor: Raymond Zappe

Issued: Jan. 27, 2004

A cover apparatus for temporarily covering access openings for water, drain, manhole and overflow pipes during construction, when the access openings are exposed, to prevent dirt, dust or unauthorized access to the access openings. The cover apparatus includes a top portion which extends beyond the access opening, a depending side wall which fits within the access opening, a outwardly flared lower side wall which extends below the depending side wall, a central ring depending from the top portion in spaced relation from the depending side wall, and a plurality of ribs extending between the central ring and the depending side wall. A pump means is secured within the central ring, and an expandable bladder in fluid communication with the pump means is positioned on the depending side wall, between the top portion and the outwardly flared side wall. When inflated, the expandable bladder seals the cover apparatus to the access opening. An annular ring may be used to position the expandable bladder on the depending side wall between the annular ring and the outwardly flared side wall.

U.S. Pat. No. 6,887,012

Inventor: Raymond Zappe

Issued: May 3, 2005

Cover apparatus for temporarily covering access openings for water, drain, manhole and overflow pipes when the access openings are exposed, such as during construction, to prevent dirt, dust or unauthorized access to the access openings includes a top portion which extends outwardly beyond the access opening, an outer depending side wall which fits within the access opening, an outwardly flared lower side wall which extends below the outer depending side wall, a central cylindrical wall depending from the top portion in spaced relation from the depending side wall, and a plurality of ribs extending between the central wall and the depending side wall. A pump is secured within the central ring, and an expandable bladder in fluid communication with the pump is positioned on the depending side wall, between the top portion and the outwardly flared side wall. When inflated, the expandable bladder seals the cover apparatus to the access opening. In place of an expandible bladder, an elastomeric seal element is used, for small diameter access openings.

U.S. Pat. No. 6,953,194

Inventor: Robert D. Brockway

Issued: Oct. 11, 2005

The expandable band is used to secure a sealing element within a generally cylindrical structure, such as a pipe or manhole, or other round hole. The expandable band includes a band body having a first band end portion and a second band end portion. The first band end portion includes a plurality of slots, and the second band end portion includes a first and second aperture. A locking member is a separate element adapted to fit within the first and second apertures and includes a first tab for extending through the first aperture and into one of the plurality of slots to lock the expandable band at the desired diameter and a second tab for engaging the second aperture. The second tab is designed not to interfere with the first band end portion while expanding the band. The locking member may also include at least one rib or protrusion.

U.K. Patent Number GB 1032839

Inventor: Thurman Allen Pelsue

Issued: Jun. 15, 1966

An extension 10, for use with manholes which are bordered by a ring 12 and have a lid-sup-porting shoulder 16 recessed into their top, comprises an upstanding tubular member 24 having at each end a pair 32, 34 and 42, 44 of spaced-apart parallel flanges which are connected by a cylindrical wall section, 36 or 46, and which house therebetween a resilient inflatable ring 26; the one wall section 46 comprising a part of the wall member 24 and the other 36 being of lesser diameter, and the radial flange 32 comprising the connection between the wall member 24 and the wall section 36 which is of reduced diameter. The extension is seated on the shoulder 16 and the ring 26 is inflated to form a fluid-tight joint in the shoulder recess 20 of the ring 12. The outer diameter of the inflatable ring between the small-diameter flanges is substantially the same as the internal diameter of the wall member 24, so that the extensions may be stacked one upon another. Apertures 38 and 48 are provided through the wall sections 36 and 46 for the inflation valves 40 of the rings.

U.K. Patent Number GB2285479

Inventor: Alexander I. S. Mitchell, et al.

Issued: Jul. 12, 1995

An inflatable tubular shuttering device comprising a collapsible member the wall portions of which include a plurality of lengthwise extending inflatable elongate chambers. The member (6) may be placed between two spaced apart confronting pipe end portions (10, 12) in an excavated manhole (8) so as to permit concrete to be poured thereabout to form a channel or culvert between the pipe ends when the shuttering device is removed. The lengthwise extending margins of the device can be secured to a rigidwalled enclosure (48), FIG. 11, of generally rectangular plan and adapted to permit the moulding in concrete of a shaft within the manhole (8'). The enclosure walls are adjustable to accommodate pipe end dimensions and spacings within the manhole.

U.S. Pat. No. 2,000,055289

Inventor: Hirano Tamio

Issued: Feb. 22, 2000

PROBLEM TO BE SOLVED: To repair a fitting part between a manhole bottom side and a pipe by setting the shape of a repair material matching and combining a cylindrical shape and a semicircular shape, or the shapes of the pipe and the manhole bottom side respectively.

SOLUTION: A repair material 8 is composed of a shape formed by integrally combining a circular one for a manhole bottom side and a cylindrical one for the inner face of a pipe 11 beforehand and the cylindrical material fitted to a pressure press-fit tube is formed by stacking the both ends together. The opening part of the repair material 8 installed around the outer circumference of a press-fit means is closed before the repair and, when the repair material 8 is pressed in contact with the fitting part between the manhole bottom side 12 and the pipe 11, it is opened by the adhesion of the resin. After installed in the repair device, this repair material 8 can be surely raised by the inflation of the press-fit means to be inflated by air so that the repair material 8 can be surely pressurized in contact with the inside of the pipe 11 and surely and closely stuck to the fitting part.

European Patent Application Number EP1329558

Inventor: Metz, Gudrun, et al.

Issued: Jul. 23, 2003

Device (10) for lifting shaft covers (6) of inspection shafts at street level (8) comprises spacer elements (12) between the upper edge of the shaft (2) and the shaft cover, a shell device (14) producing a seal between the inner wall (16, 17) of the shaft and the shaft cover, and at least one filling tube (20, 21) having one end protruding into the annular hollow space formed by the spacer elements between the shaft edge and the shaft cover and via which sealing compound is pressed into the hollow space to raise the shaft cover. Preferred Features: The spacer elements are adjustable. The shell device is a hollow, elastically inflatable component (18) designed as a cushion or a closed hollow cylindrical body or double-walled cylindrical casing made of elastic material.

While these manhole covers may be suitable for the purposes for which they were designed, they would not be as suitable for the purposes of the present invention, as hereinafter described.

SUMMARY OF THE PRESENT INVENTION

A primary object of the present invention is to provide a temporary insert for a manhole passageway.

Another object of the present invention is to provide a temporary manhole insert incorporating adjustable securing means.

Yet another object of the present invention is to provide a temporary manhole insert having a rigid central portion.

Still yet another object of the present invention is to provide a temporary manhole insert wherein said central portion is rigid.

Another object of the present invention is to provide a temporary manhole insert wherein said central portion is fastened to a peripherally positioned inflatable member.

Yet another object of the present invention is to provide a temporary manhole insert wherein said inflatable member is selectively inflatable after initial placement.

Still yet another object of the present invention is to provide a temporary manhole insert wherein said insert is positioned within the bore of the opening and inflated thereby compressionally held therein.

Additional objects of the present invention will appear as the description proceeds.

The present invention overcomes the shortcomings of the prior art by providing an improved temporary manhole insert for securing a manhole passageway having a generally cylindrical structure with an inflatable, ring like tube encompassing the outer rim of the rigid portion of the insert.

The insert with the inflatable rim is placed within the manhole aperture and then inflated to expand until the insert is secured in position. The manhole insert of the present invention prevents debris such as rocks, dust, asphalt and other debris from falling into the manhole during adjustments to the casting and also prevents debris from going into the sewer system such as pipes and pumps.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
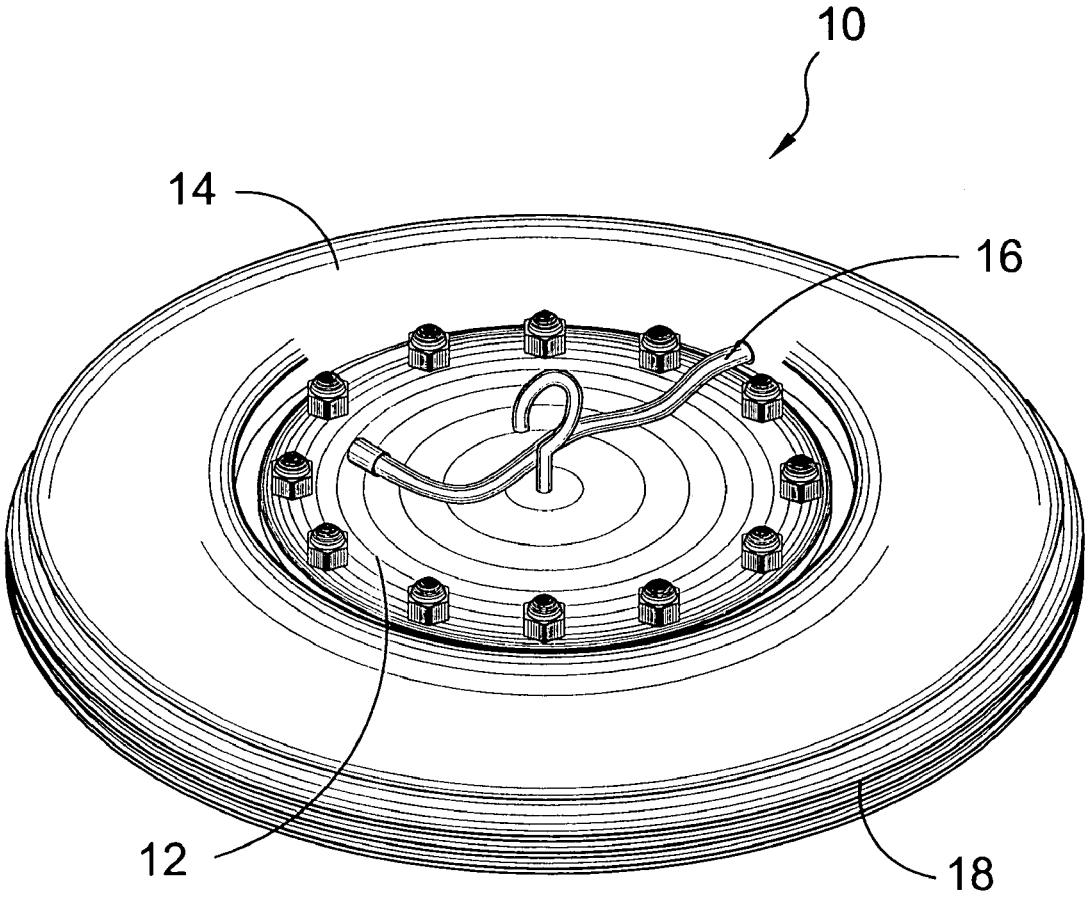
FIG. 1 is a perspective view of the present invention.

Turning now descriptively to the drawings, in which similar reference characters denote similar elements throughout the several views, the figures illustrate the Manhole Insert of the present invention. With regard to the reference numerals used, the following numbering is used throughout the various drawing figures.

10 Manhole Insert of the present invention
12 center cap
14 inflatable body
16 inflation assembly
18 sealing vein
20 bolt
22 connection ring
24 hook member
26 threaded bolt recess of 22
27 bolt recesses of 12
28 manhole
30 pressurized air source
36 manhole wall
38 central recess of 22

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a perspective view of the present invention 10. Shown is the present invention 10, a manhole insert 10 for sealing a sewer's manhole comprising substantially circular center cap 10 that secures a peripheral, selectively inflatable body 14 of a ring-like shape that when inflated enlarges to a greater circumference than a manhole's entrance way to effectively create a frictional bond upheld by consistent force applied utilizing force exerted and bound in the pressurized body 14. The inflatable body 14 includes an associated inflation assembly 16 to provide a connection to a pressurized air source to allow for the introduction and release of pressurized air therein. A plurality of sealing veins 18 serve to enhance the efficiency of the frictional seal forced against the wall of the manhole. The manhole insert 10 of the present invention prevents debris such as rocks, dust, asphalt and other debris from falling into the manhole during adjustments to the casting such as, but not limited to, asphalt overlay.

Figure 2:
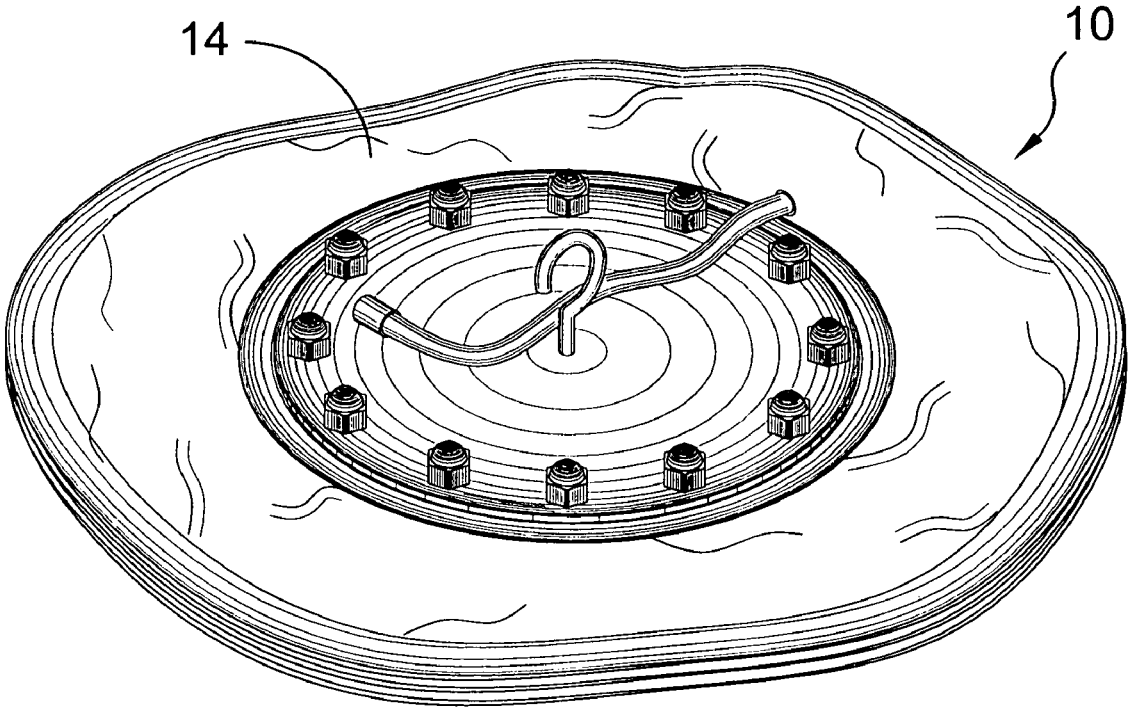
FIG. 2 is a perspective view of the present invention deflated.

FIG. 2 is a perspective view of the present invention 10 deflated. Shown is the present invention 10 with the inflatable body 14 in the deflated state. When deflated, the inflatable body is flaccid allowing the manhole insert 10 to be selectively placed within the entrance of a manhole Whereby when inflated the device will fixate in place via a frictional pressure-induced bond.

Figure 3:
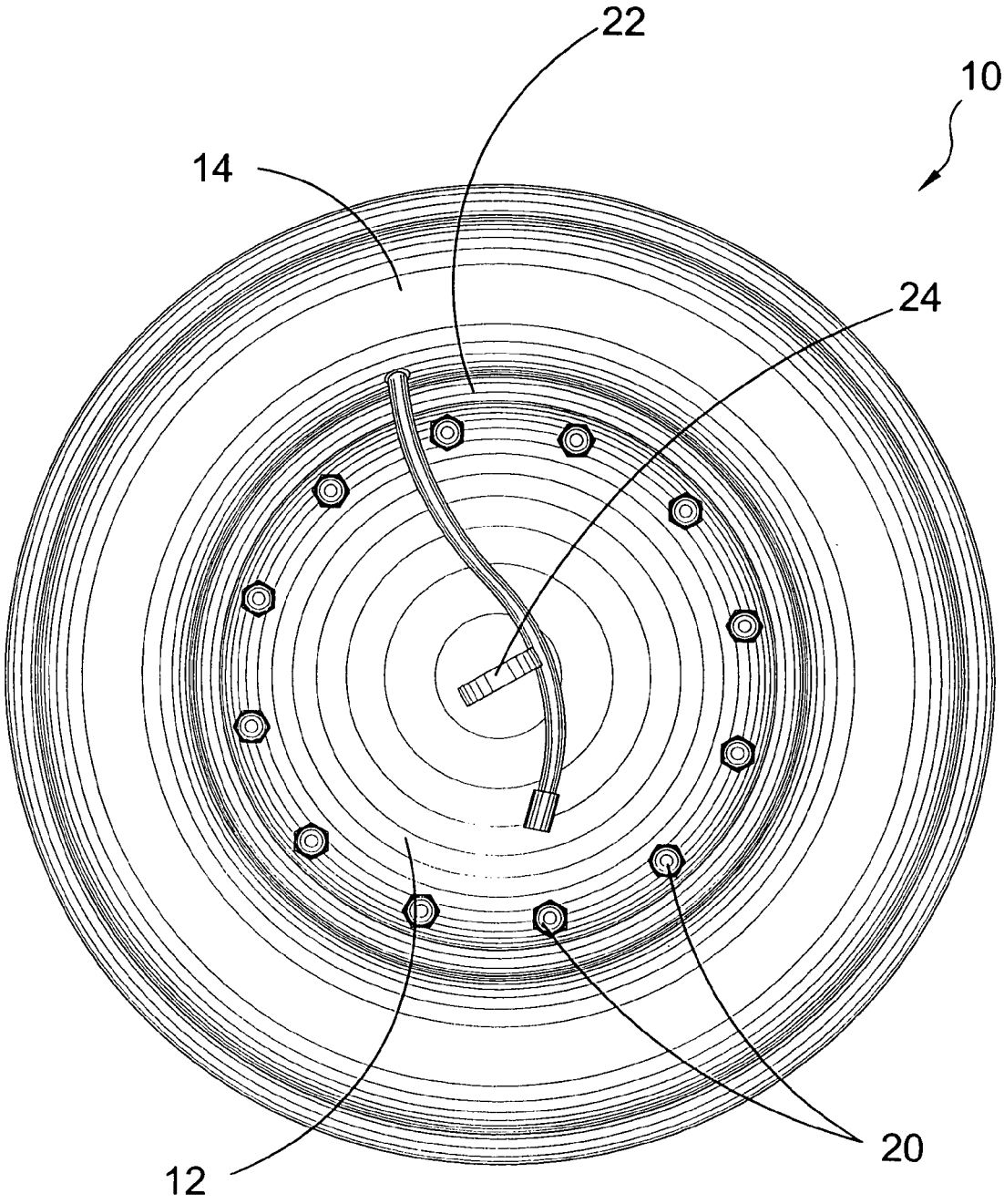
FIG. 3 is a top view of the present invention.

FIG. 3 is a top view of the manhole insert of the present invention 10. Shown is the manhole insert 10 having a center cap 12 secured via bolts 20 to a connection ring 22 that is integral with the inflatable body 14. In the event that the user wishes to gain access through the manhole insert 10, the user removes the center plate 12 via the removable bolts 20 to gain access therebelow. A centrally disposed hook member 24 is provided for lifting and lowering the center plate 12 individually or with the inflatable body 14 attached thereto.

Figure 4:
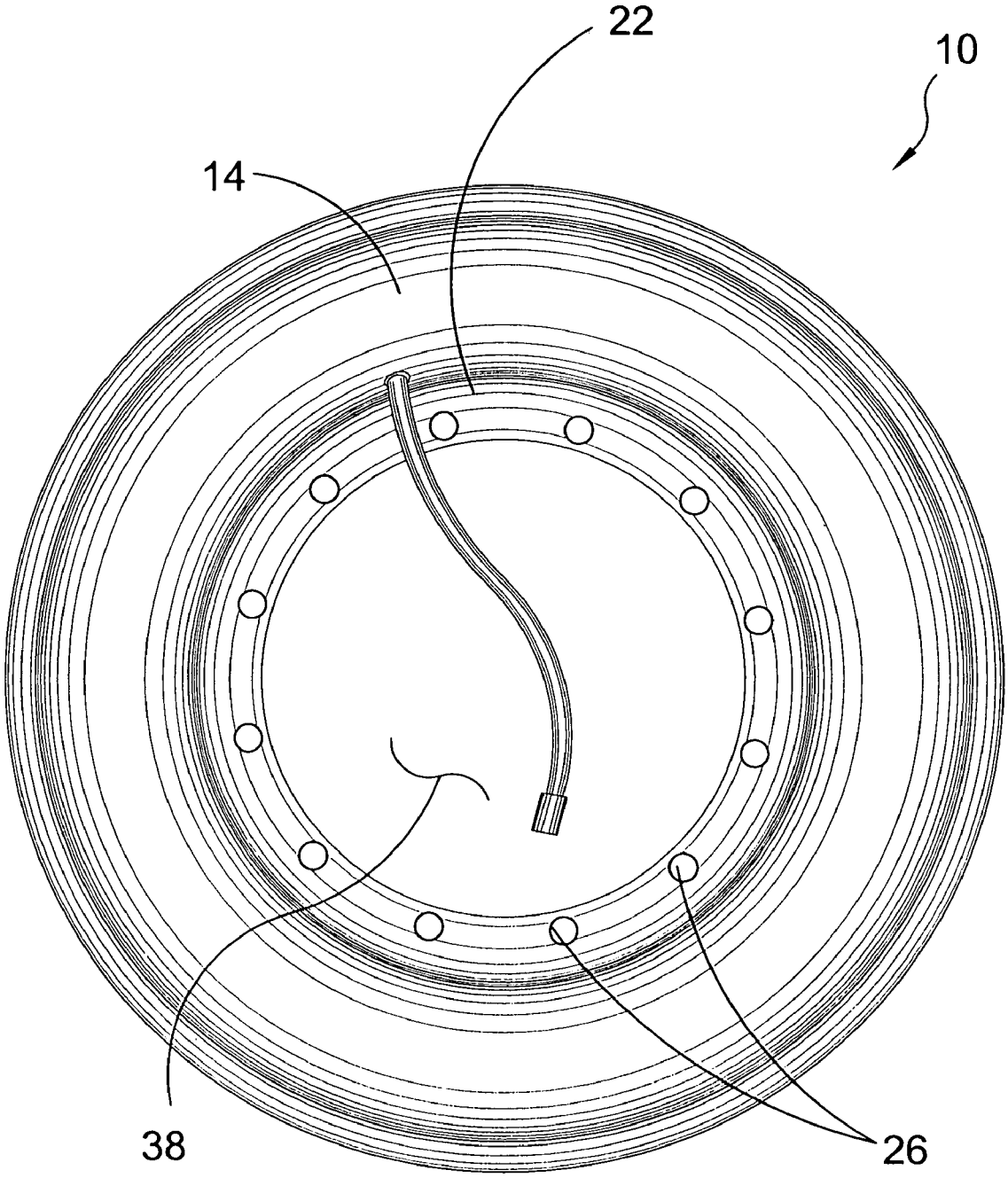
FIG. 4 is a top view of the present invention with the center cap removed.

FIG. 4 is a top view of the present invention 10 with the center cap removed. Shown is the manhole insert 10 having the center cap removed to provide access through the connection ring 22 having a large central recess 38. The threaded bolt recesses 26 of the connection ring 22 are also shown. The manhole insert 10 with the inflatable body 14 is placed within the manhole and then inflated to expand until the insert 10 is secured in position against the wall thereof. The manhole insert 10 prevents debris such as rocks, dust, asphalt and other debris from falling into the manhole during adjustments to the casting but not limited to.

Figure 5:
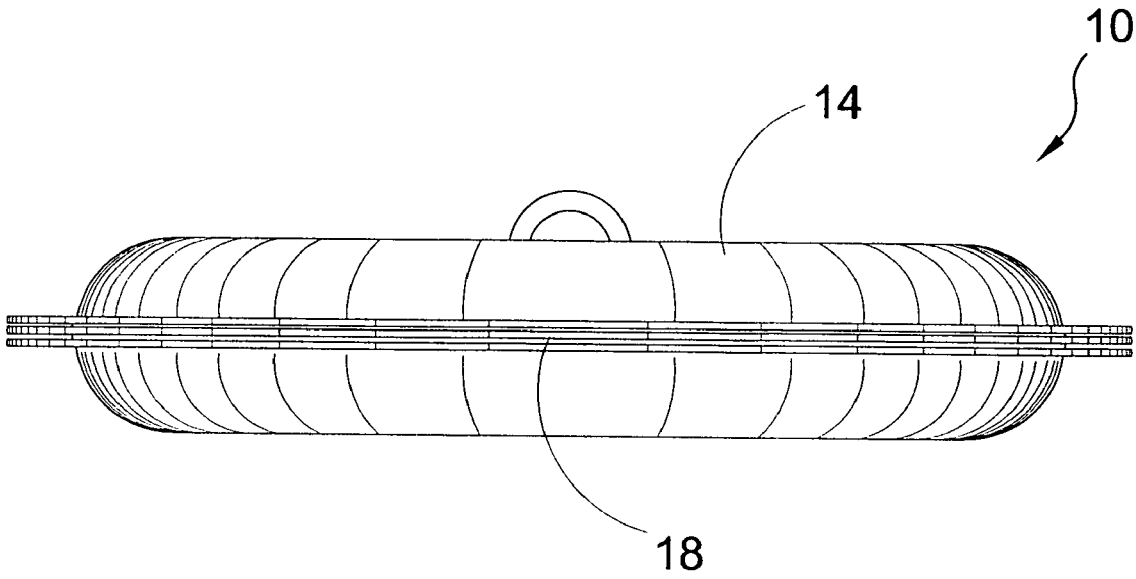
FIG. 5 is a side view of the present invention.

FIG. 5 is a side view of the present invention 10. Shown is a side view of the manhole insert 10 depicting the presence of sealing veins 18 that provide a more secure and durable seal when the inflatable body 14 is inflated. The sealing veins 18 also serve to prevent puncture of the inflatable body 14 during installation.

Figure 6:
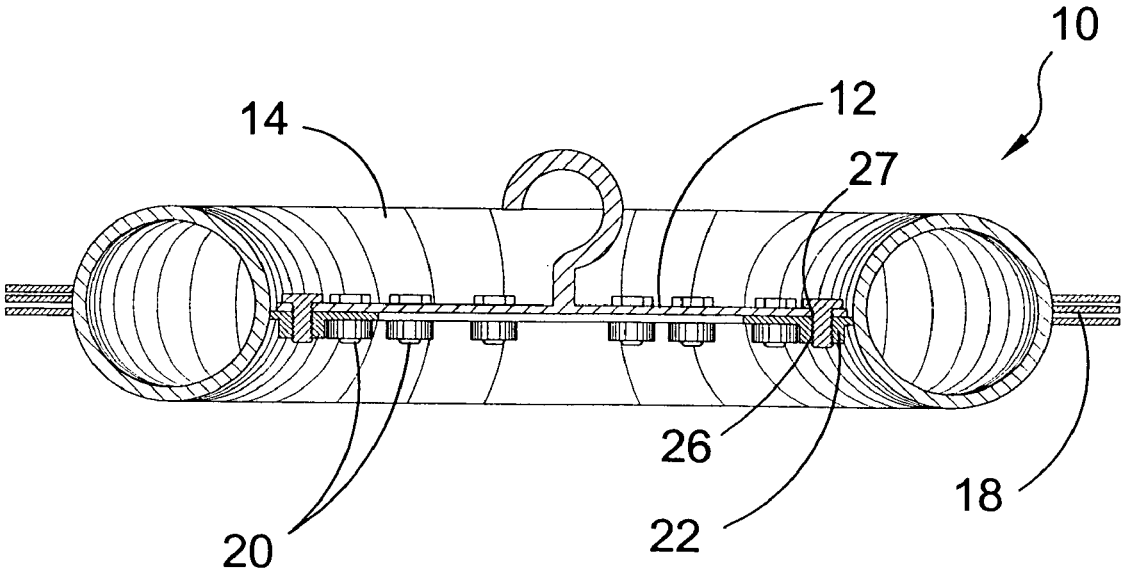
FIG. 6 is a cross sectional view of the present invention.

FIG. 6 is a cross sectional view of the present invention 10. Shown is a sectional view of the manhole insert 10 showing how the inflatable body 14 provides an inflatable cavity. Additionally shown is the connection ring 22 having threaded bolt recesses 26 for direct threaded bolt 20 connection of the center cap 12 thereto. The center cap 12 includes bolt recesses 27 aligned with the threaded bolt recesses 26 of the connection ring 22. The relation between the inflatable body 14 and the sealing vanes 18 is also shown.

Figure 7:
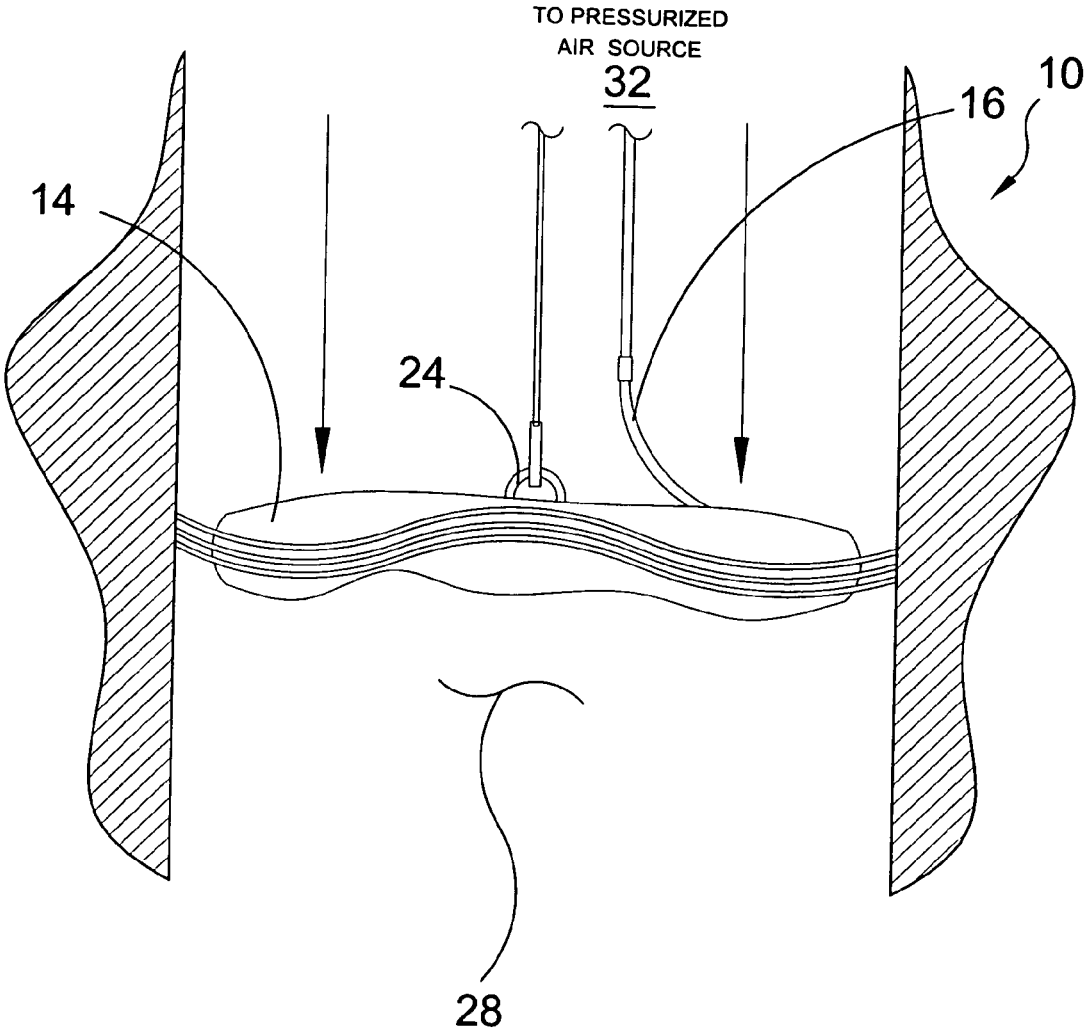
FIG. 7 is an illustrative view of the present invention in use.

FIG. 7 is an illustrative view of the present invention 10 in use. Shown is the installation of the manhole insert 10 through a manhole 28 as it is lowered into place via the hook member 24. The inflatable body 14 is then inflated till secured by utilizing a pressurized air source 32 in communication with the inflation assembly 16.

Figure 8:
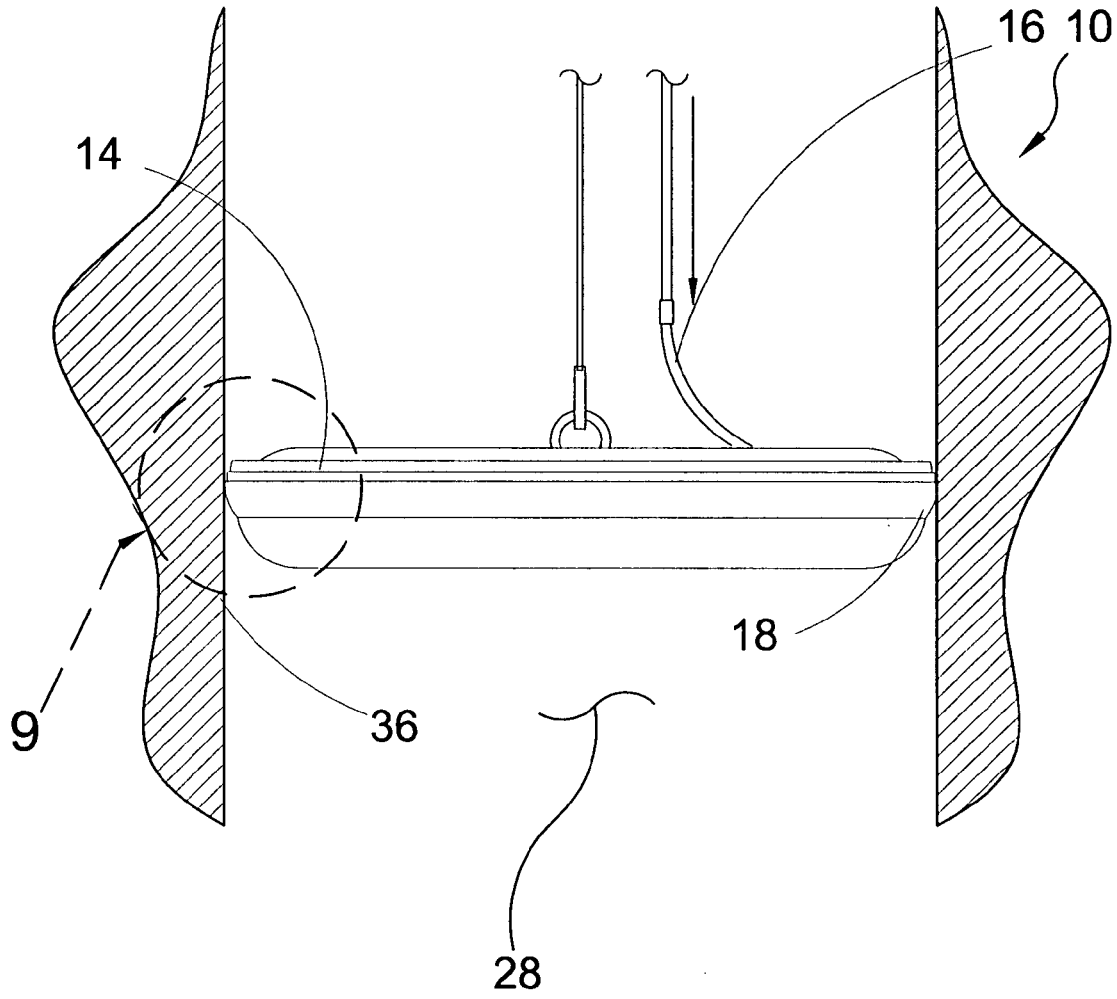
FIG. 8 is an illustrative view of the present invention installed.

FIG. 8 is an illustrative view of the present invention 10 installed. Shown is the manhole insert 10 installed within the manhole 28 with the inflatable body 14 fully inflated thereby collapsing the sealing veins 18 against the manhole wall 36. The pressurized air therein can be released later by bleeding the inflation assembly 16.

Figure 9:
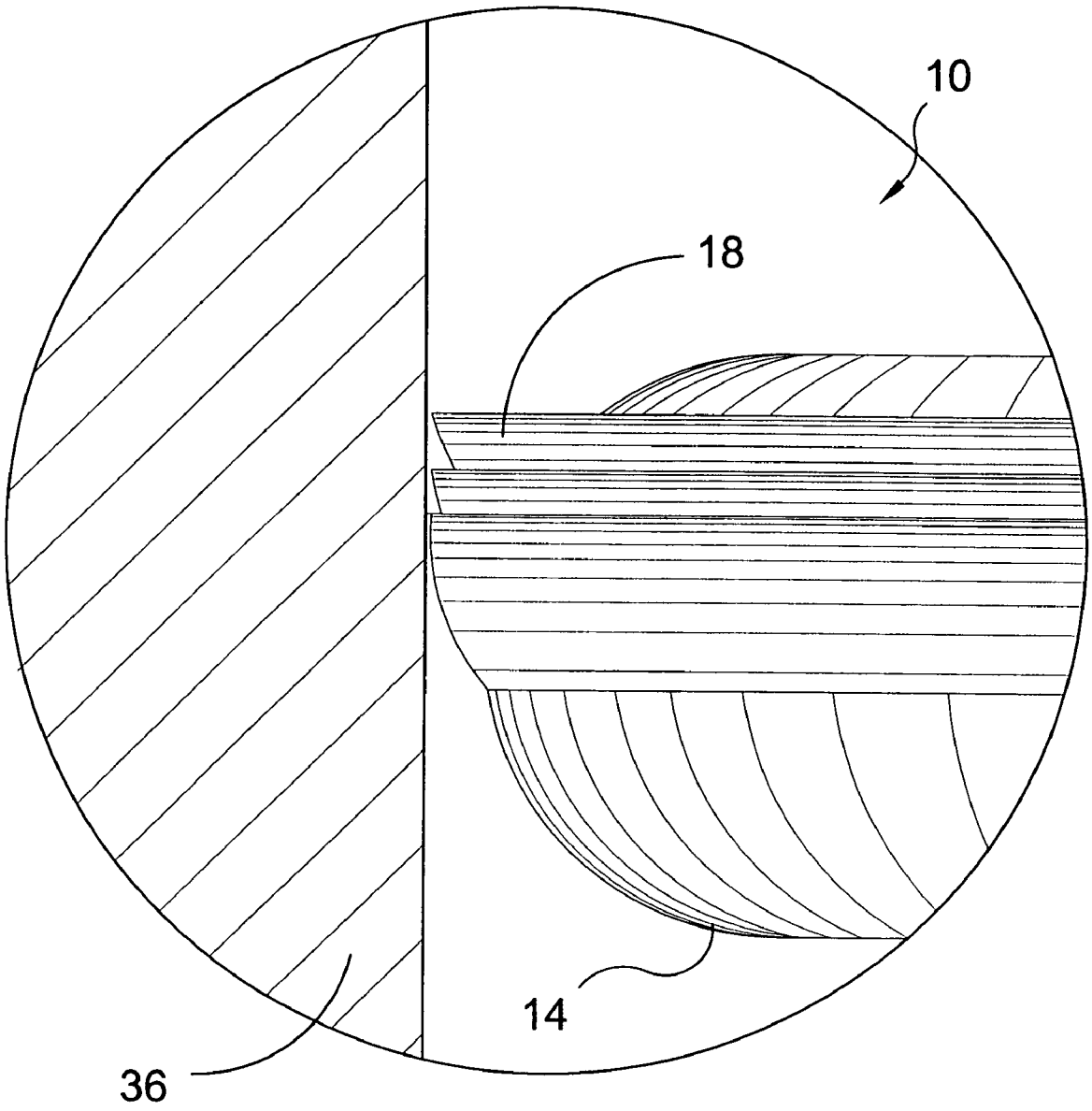
FIG. 9 is an enlarged view of the sealing veins of the present invention.

FIG. 9 is an enlarged view of the sealing veins 18 of the present invention 10. Shown is an enlarged view of how the sealing veins 18 serve to create a more effective seal against the manhole wall 36 and protect the inflatable body 14.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed in new and desired protected Letters Patent is set forth in the appended claims:

1. An inflatable manhole insert comprising:

a) a center cap;

b) a closed, flexible member forming an inflatable body connected to the periphery of said manhole insert;

c) a plurality of sealing veins extending from the outer circumference of said inflatable body;

d) means for selectively inflating and deflating said inflatable body;

e) a plurality of bolt recesses evenly spaced proximal the peripheral edge of said center cap;

f) a connection ring integral with the inner circumference of said inflatable body and having a substance central recess disposed therein;

g) a plurality of evenly spaced threaded bolt recesses disposed on said connection ring arranged to align with said bolt recesses of said center cap; and h) a plurality of bolts to pass through said center cap bolt recesses into said threaded connection ring bolt recesses and secure said center cap to said connection ring.

2. An inflatable manhole insert as recited in claim 1, wherein said inflation/deflation means is a tube forming an inflation assembly having a proximal end in communication with the interior of said inflatable body and a distal end having a means for connecting to a pressurized air source.

3. An inflatable manhole insert as recited in claim 1, wherein said center cap further includes a hook member extending from a central top portion thereof.

4. An inflatable manhole insert as recited in claim 3, wherein said manhole insert is installed for use by lowering said manhole insert using said hook member into a manhole.

5. An inflatable manhole insert as recited in claim 4, wherein said manhole insert is secured within said manhole once placed in the desired position within said manhole by introducing pressurized air into said inflation assembly and said inflatable body thereby inflating said body to form a frictional engagement between said body and it's associated sealing veins and the manhole wall.

6. An inflatable manhole insert as recited in claim 1, wherein access through said manhole insert may be achieved without the removal thereof by removing said bolts and said center cap from said connection ring to allow passage through said central recess of said connection plate said center cap and bolts are subsequently replaced when access is no longer required.

7. An inflatable manhole insert as recited in claim 5, wherein said manhole insert is prepared for removal by permitting the air to bleed out from said inflatable body.

8. An inflatable manhole insert as recited in claim 1, wherein said connection ring and said center cap are fabricated of a metallic material.

9. An inflatable manhole insert as recited in claim 1, wherein said connection ring and said center cap are fabricated of a sturdy plastic polymer.

* * * * *